US010995571B2

(12) United States Patent
Zheng et al.

(10) Patent No.: US 10,995,571 B2
(45) Date of Patent: May 4, 2021

(54) IMAGE BASED SYSTEM FOR DRILLING OPERATIONS

(71) Applicant: SCHLUMBERGER TECHNOLOGY CORPORATION, Sugar Land, TX (US)

(72) Inventors: Shunfeng Zheng, Katy, TX (US); Richard John Meehan, Houston, TX (US); John David Rowatt, Katy, TX (US); Vishwanathan Parmeshwar, Houston, TX (US); Joergen Kringen Johnsen, Houston, TX (US); Sylvain Chambon, Issy les Moulineaux (FR)

(73) Assignee: Schlumberger Technology Corporation, Sugar Land, TX (US)

( * ) Notice: Subject to any disclaimer, the term of this patent is extended or adjusted under 35 U.S.C. 154(b) by 224 days.

(21) Appl. No.: 16/304,330

(22) PCT Filed: May 24, 2017

(86) PCT No.: PCT/US2017/034098
§ 371 (c)(1),
(2) Date: Nov. 26, 2018

(87) PCT Pub. No.: WO2017/210033
PCT Pub. Date: Dec. 7, 2017

(65) Prior Publication Data

US 2019/0136650 A1 May 9, 2019

Related U.S. Application Data

(60) Provisional application No. 62/341,522, filed on May 25, 2016.

(51) Int. Cl.

| | |
|---|---|
| ***E21B 19/16*** | (2006.01) |
| ***E21B 44/00*** | (2006.01) |
| ***E21B 3/02*** | (2006.01) |

(52) U.S. Cl.
CPC ..... *E21B 19/166* (2013.01); *E21B 3/02* (2013.01); *E21B 19/165* (2013.01); *E21B 44/00* (2013.01); *E21B 44/005* (2013.01)

(58) Field of Classification Search
CPC ..... E21B 19/165; E21B 19/166; E21B 44/00; E21B 44/005; E21B 3/02
See application file for complete search history.

(56) References Cited

U.S. PATENT DOCUMENTS 4,459,752 A 7/1984 Babcock
5,107,705 A * 4/1992 Wraight ..... E21B 45/00 73/152.03

(Continued)

FOREIGN PATENT DOCUMENTS

RU 2324812 C1 5/2008
RU 2593609 C1 8/2016

(Continued)

OTHER PUBLICATIONS

Office Action and Search Report issued in Russian Patent Application No. 2018145326/03 dated Aug. 10, 2020; 12 pages (with English translation).

*Primary Examiner* — David Carroll
(74) *Attorney, Agent, or Firm* — Jeffrey D. Frantz

(57) ABSTRACT

A drilling rig site may include at least one tubular configured to be inserted into a wellbore at the drilling rig, at least one imaging device configured to detect a location of an end of the at least one tubular or a feature of the at least one tubular, and a processor receiving an input from the at least one imaging device and configured to calculate a distance between the end of the at least one tubular and another element, a diameter of the at least one tubular, or movement of the at least one tubular. A method for completing a drilling operation at a rig site, may include capturing an image of a tubular at a rig site, the tubular configured to be inserted into (Continued)

a wellbore at the rig site, detecting a location of an end of the tubular or a feature of the tubular from the image, and determining a diameter of the tubular, a distance between the detected end of the tubular and another element, or movement of the tubular.

11 Claims, 4 Drawing Sheets

(56) References Cited

U.S. PATENT DOCUMENTS

| | | | |
|---|---|---|---|
| 6,892,812 | B2 | 5/2005 | Niedermayr et al. |
| 6,896,055 | B2 | 5/2005 | Koithan |
| 6,931,621 | B2 | 8/2005 | Green et al. |
| 7,172,037 | B2 | 2/2007 | Dashevskiy et al. |
| 7,264,050 | B2 | 9/2007 | Koithan et al. |
| 7,357,196 | B2 | 4/2008 | Goldman et al. |
| 7,860,593 | B2 | 12/2010 | Boone |
| 7,938,197 | B2 | 5/2011 | Boone et al. |
| 8,121,971 | B2 | 2/2012 | Edwards et al. |
| 8,215,417 | B2 | 7/2012 | Annaiyappa et al. |
| 8,250,816 | B2 | 8/2012 | Donnally et al. |
| 8,386,059 | B2 | 2/2013 | Boone |
| 8,590,635 | B2 | 11/2013 | Koederitz |
| 8,718,802 | B2 | 5/2014 | Boone |
| 9,027,671 | B2 | 5/2015 | Koederitz |
| 9,223,594 | B2 | 12/2015 | Brown |
| 9,285,794 | B2 | 3/2016 | Wang et al. |
| 9,410,417 | B2 | 8/2016 | Reckmann et al. |
| 9,429,009 | B2 | 8/2016 | Paulk et al. |
| 9,436,173 | B2 | 9/2016 | Wang et al. |
| 9,506,336 | B2 | 11/2016 | Orbell |
| 9,528,364 | B2 | 12/2016 | Samuel et al. |
| 9,593,567 | B2 | 3/2017 | Pink et al. |
| 9,598,947 | B2 | 3/2017 | Wang et al. |
| 9,784,089 | B2 | 10/2017 | Boone et al. |
| 9,828,845 | B2 | 11/2017 | Kpetehoto et al. |
| 9,896,925 | B2 | 2/2018 | Hernandez et al. |
| 9,933,919 | B2 | 4/2018 | Raja et al. |
| 9,934,338 | B2 | 4/2018 | Germain et al. |
| 9,938,816 | B2 | 4/2018 | Astrid et al. |
| 9,946,445 | B2 | 4/2018 | Whalley |
| 9,959,022 | B2 | 5/2018 | Anghelescu et al. |
| 9,988,880 | B2 | 6/2018 | Dykstra |
| 9,995,129 | B2 | 6/2018 | Dykstra et al. |
| 10,113,408 | B2 | 10/2018 | Pobedinski et al. |
| 10,138,722 | B2 | 11/2018 | Magnuson |
| 2007/0097789 | A1 | 5/2007 | Coffey |
| 2008/0105427 | A1 | 5/2008 | Hampton et al. |
| 2013/0271576 | A1 | 10/2013 | Ellis |
| 2013/0275100 | A1 | 10/2013 | Ellis et al. |
| 2014/0210821 | A1 | 7/2014 | Kapoor et al. |
| 2014/0233804 | A1* | 8/2014 | Gustavsson ..... G06T 7/0004 382/103 |
| 2014/0353033 | A1* | 12/2014 | Pink ..... E21B 44/00 175/27 |
| 2015/0345261 | A1* | 12/2015 | Kruspe ..... E21B 7/00 175/40 |
| 2015/0369030 | A1 | 12/2015 | Hay et al. |
| 2016/0024906 | A1 | 1/2016 | Jamison et al. |
| 2017/0308802 | A1 | 10/2017 | Ramsoy et al. |
| 2018/0156023 | A1 | 6/2018 | Dykstra et al. |
| 2018/0298693 | A1 | 10/2018 | Van Duivendijk et al. |
| 2018/0298694 | A1 | 10/2018 | Van Duivendijk et al. |
| 2018/0328159 | A1 | 11/2018 | Mandava et al. |
| 2018/0334887 | A1 | 11/2018 | Dashevskiy et al. |

FOREIGN PATENT DOCUMENTS

| | | | |
|---|---|---|---|
| WO | 03087714 | A1 | 10/2003 |
| WO | 2012038863 | A1 | 3/2012 |
| WO | 2017204655 | A1 | 11/2017 |
| WO | 2018186745 | A1 | 10/2018 |

* cited by examiner

IMAGE BASED SYSTEM FOR DRILLING OPERATIONS

CROSS-REFERENCE TO RELATED APPLICATIONS

This application claims priority to U.S. Patent Application No. 62/341,522, filed on May 25, 2016, which is herein incorporated by reference in its entirety.

BACKGROUND

A drilling rig is used in common drilling methods and systems used in drilling boreholes to produce oil or other hydrocarbons. A drilling rig may include a power rotating means, such as a kelly drive and a rotary table, or a top drive, which delivers torque to a drill string. The drill string rotates a drill bit located at its lowermost end and thereby produces a borehole in the formation below the drilling rig.

The drill string is commonly composed of multiple tubulars, which are added to the drill string sequentially, such that the portion of the drill string which protrudes from the wellbore remains within a specified range of heights as the wellbore is being drilled. Operations carried out by equipment on the drilling rig to add tubulars to the drill string may depend on characteristics of the tubulars. Distances between tubulars, properties of threads of the tubulars, and the torque and rotational speed experienced by the tubulars making up the drill string may inform the desired operation of drilling rig equipment. It may be desired to measure such properties and others in real-time on a drilling rig site.

A drilling rig site that does not have such measurements in real-time or close to real-time may experience inefficiencies caused by beginning or ceasing operation of drilling rig equipment when tubulars are not in a preferred location. Components of a drilling rig site whose operation is not informed by such measurements may be subject to damage as due to operation under non-ideal conditions.

SUMMARY OF THE DISCLOSURE

In one aspect, this disclosure relates to a drilling rig site including at least one tubular configured to be inserted into a wellbore at the drilling rig, at least one imaging device configured to detect a location of an end of the at least one tubular or a feature of the at least one tubular, and a processor receiving an input from the at least one imaging device and configured to calculate a distance between the end of the at least one tubular and another element, a diameter of the at least one tubular, or movement of the at least one tubular.

In another aspect, this disclosure relates to method for completing a drilling operation at a rig site, including capturing an image of a tubular at a rig site, the tubular configured to be inserted into a wellbore at the rig site, detecting a location of an end of the tubular or a feature of the tubular from the image, and determining a diameter of the tubular, a distance between the detected end of the tubular and another element, or movement of the tubular.

Other aspects and advantages will be apparent from the following description and the appended claims.

DETAILED DESCRIPTION

Figure 1:
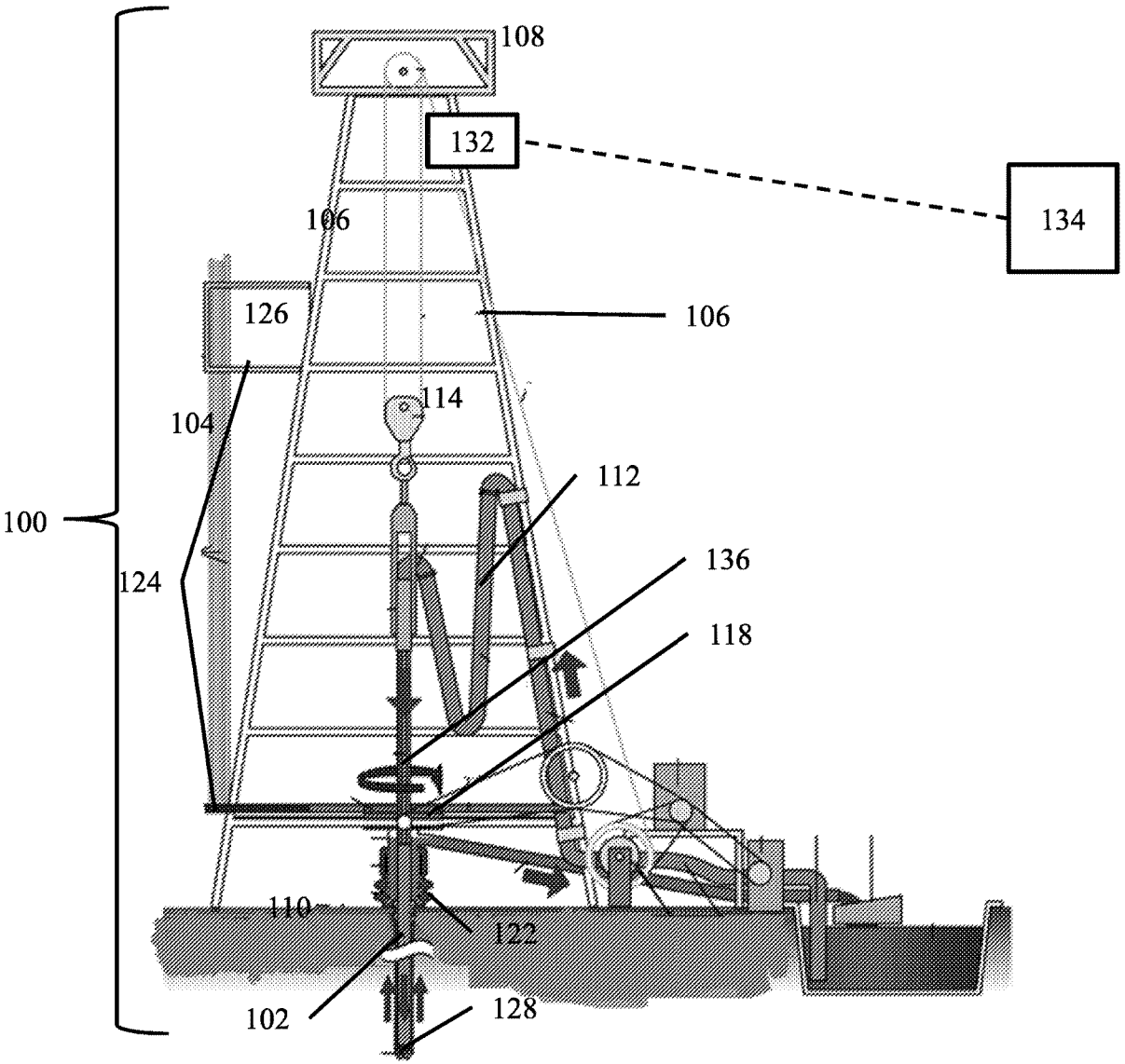
FIG. 1 is a schematic of a drilling rig site in accordance with the present disclosure.

Embodiments of the present disclosure will now be described in detail with reference to the accompanying Figures. Like elements in the various figures may be denoted by like reference numerals for consistency. Further, in the following detailed description of embodiments of the present disclosure, numerous specific details are set forth in order to provide a more thorough understanding of the claimed subject matter. However, it will be apparent to one of ordinary skill in the art that the embodiments disclosed herein may be practiced without these specific details. In other instances, well-known features have not been described in detail to avoid unnecessarily complicating the description. Additionally, it will be apparent to one of ordinary skill in the art that the scale of the elements presented in the accompanying Figures may vary without departing from the scope of the present disclosure.

In one aspect, the present disclosure relates to a drilling rig site including at least one tubular, at least one imaging device, and at least one processor. The tubular may be configured to be inserted into a wellbore at the drilling rig. The imaging device may be configured to capture an image of a location of an end of the at least one tubular. The processor may receive an input from the at least one imaging device. The processor may be configured to detect a location of an end of the at least one tubular based on the image. The processor may be configured to calculate a distance between the end of the at least one tubular and another element, or to calculate a diameter of the at least one tubular.

In some embodiments, the systems and methods of the present invention may be used and practiced in association with any type of drilling rig used in the industry, for example, on-shore, off-shore, floating platforms, rotary table drives, top drives, etc.

FIG. 1 illustrates a drilling rig in accordance with the present disclosure. The drilling rig 100 may be used to drill a wellbore 102. The drilling rig site may include at least one tubular 104. The drilling rig 100 may also include a vertical derrick 106 having a crown block 108 at an upper end and a horizontal rig floor 110 at a lower end. The derrick 106 may support a Kelly Hose 112 which may be suspended from a travelling block 114.

Figure 2:
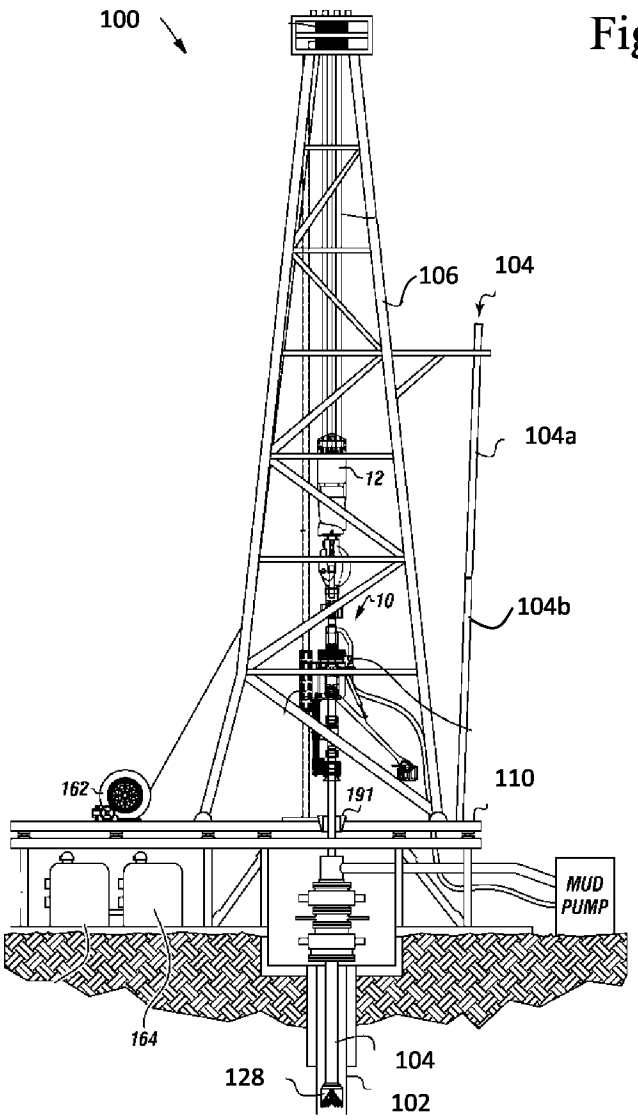
FIG. 2 is a schematic of a drilling rig site in accordance with the present disclosure.

The drilling rig 100 may include a kelly drive 136 and a rotary table 118, as shown in FIG. 1. The kelly drive 136 and the rotary table 118 may be supported by the vertical derrick 106. The kelly drive 136 and the rotary table 118 may be capable of drilling tubulars 104 of up to ninety feet in length. In some embodiments, the drilling rig 100 may not include a kelly drive 136 or a rotary table. In some embodiments, as shown in FIG. 2, the drilling rig 100 may include a top drive 10. The top drive 10 may be attached to the vertical derrick 106 by means that allow the top drive 10 to move vertically along the derrick 106. These means may be a lifting block 12, a drawworks 162, and a drawworks motor 164. The top drive 10 may be fixedly suspended from lifting block 12, which may in turn be suspended from the derrick 106 via the drawworks 162. The drawworks 162 may be actuated by the drawworks motor 164. The drawworks motor may be disposed on the rig floor 110. The top drive 10 may be able to move over a length of over ninety feet. The top drive 10 may be capable of drilling tubulars 104 of up to ninety feet in length. In some embodiments, the drilling rig 100 may include any means to rotate and drive a tubular known in the art.

The Kelly Hose 112 may be attached to a drill string 120. The drill string 120 may be composed of tubulars 104. A lower end of the drill string 120 may be disposed within the wellbore 102. An upper end of the drill string 120 may extend out of the wellbore 102 and beyond the rig floor 110 through an opening in the rig floor 110. A slip (shown in FIG. 2 as 191) may be periodically placed within the opening in the rig floor 110. The slip may support the drill string 120 at the level of the rig floor 110 and prevent the drill string 120 from moving further into the wellbore 102 during making up a new joint or breaking up a joint during tripping in or out of the well, respectively. The slip may be capable of being tightened to prevent movement of the drill string 120 and loosened to allow movement of the drill string 120.

In some embodiments, tubulars 104 may be joined together to form stands. A stand may include two or more tubulars 104 that have been torqued together prior to being run into a wellbore. In some embodiments, a stand may include two or three tubulars 104 that have been torqued together. FIG. 2 shows a stand which includes two tubulars 114*a*, 104*b*. In this disclosure, the term tubular may be used to refer to a single tubular or a stand including two or more tubulars, unless specified otherwise. Further, while the present embodiment shows drilling string as tubulars, it is also understood that tubular may also refer, for example, to casing string or to BHA components such as drill collars, subs, measurement tools, etc. On the rig 100, individual tubulars 104 or stands of tubulars 104 may be disposed on a pipe rack 124. The pipe rack 124 may include a fingerboard 126.

In a drilling operation, a drilling rig 100 may be assembled over a site at which it is desired to create a wellbore 102. Tubulars 104 may be assembled into stands. The assembly of stands may be performed on the rig floor 110. A tool such as an iron roughneck (not shown) may be used to assemble the stands. The tubulars 104, either individually or assembled into stands, may be disposed in the pipe rack 124, such that one end of a tubular 104 is suspended from the fingerboard 126 and the other end of a tubular rests on the lower portion of the pipe rack 124. A crane (not shown) or other tool capable of lifting large loads may be used to situate the tubulars 104 in the pipe rack 124.

A drill bit 128 may be affixed to the end of a tubular 104. If the drilling rig 100 includes a kelly drive 136 and a rotary table 118, the tubular 104 may be attached to the kelly drive 136 engaged by the rotary table 118. The end of the tubular 104 which is not attached to the drill bit 128 may be attached to the kelly drive 136. If the drilling rig 16 includes a top drive 10, the end tubular 104 may be attached to the top drive 10. The tubular 104 may be attached to the top drive 10, such that the top drive 10 engages the tubular 104, at or near the end of the tubular 104 which is not attached to the drill bit 128. The tubular 104, attached to the top drive 10 or to the kelly drive 136 may be located over an opening in the rig floor 110 which allows access to the ground below. The kelly drive 136 and the rotary table 118 or the top drive 10 may support the weight of the tubular 104.

The kelly drive 136 and the rotary table 118 or the top drive 10 may rotate the tubular 104 and move the tubular 104 vertically. The drill bit 128 may cut into the ground below the rig floor 110 creating the wellbore 102. During drilling, the Kelly Hose 112 may be used to pump drilling fluid or drilling mud into the drill string 120. The drilling fluid or drilling mud may lubricate the drill bit 128 during the drilling operation and bring the drilled cuttings to the surface.

Figure 3:
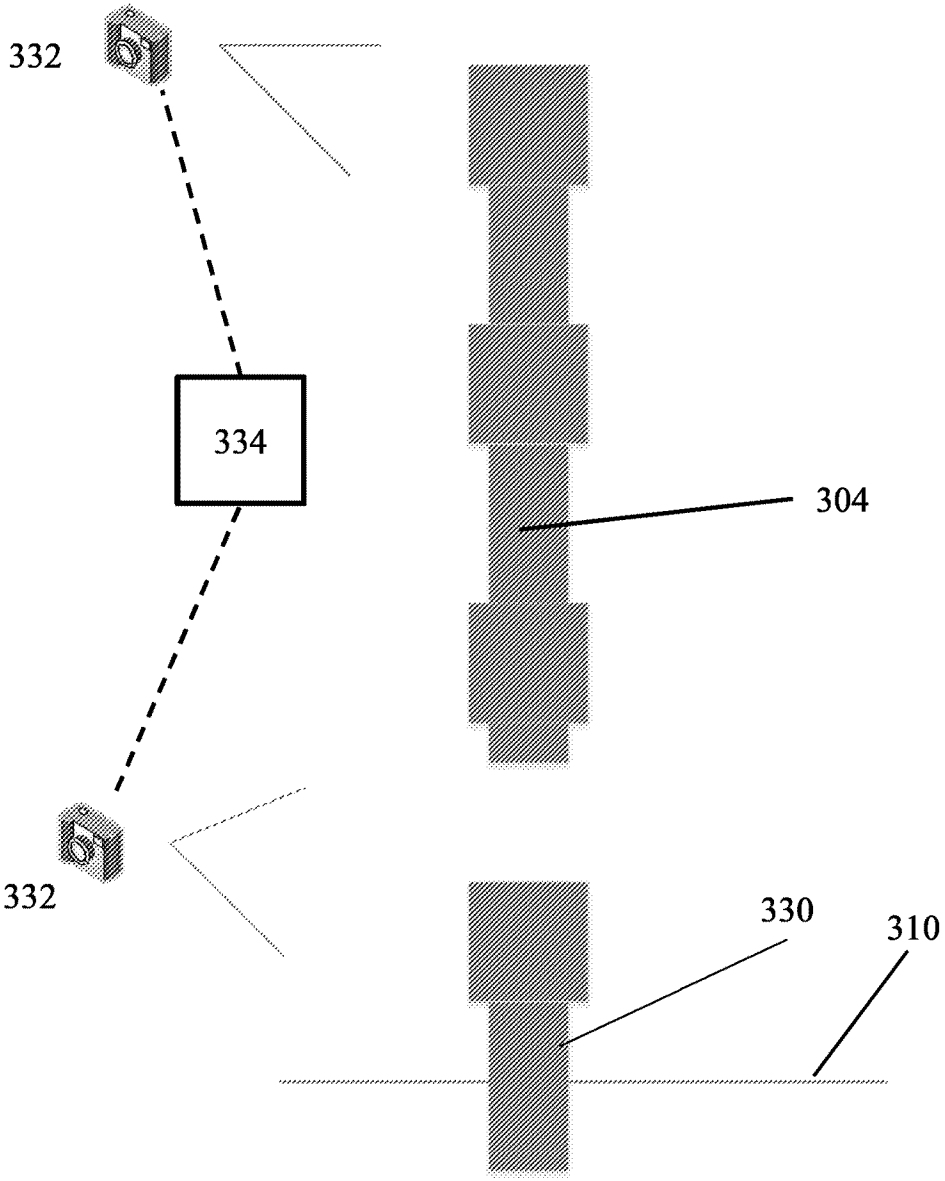
FIG. 3 is a schematic of a drilling rig site in accordance with the present disclosure.

When a portion of the tubular 104 is below the rig floor 110, the rotation and vertical movement of the kelly drive 136 or top drive 10 may be stopped. The majority of the tubular 104 may be below the rig floor 110. The portion of the tubular 104 which is above the rig floor 110 may be referred to as the stick-up. The stick-up 330 is shown in FIG. 3. The slip (shown in FIG. 2 as 191) may be tightened around the tubular 104 and support the weight of the tubular 104. The tubular 104 may be disconnected from the top drive 10 or the kelly drive 136. The top drive 10 or the kelly drive 136 may be moved vertically upwards away from the stick-up 330.

A tubular 104 may be removed from the pipe rack 126. The tubular 104 may be arranged such that one end of the tubular 104 is proximate the end of the stick-up 330. The tubular 104 may be supported by a crane (not shown) or by another tool capable of lifting large loads. The tool may be attached to and supported by the derrick 106. When the end of the tubular 104 is a desired distance from the end of the stick-up 330, an iron roughneck (not shown) or other tool may be used to torque the tubular 104 to the stick-up 330. The end of the tubular 104 which is not attached to the stick-up 330 may be attached to the kelly drive 136 and the rotary table 118 or the top drive 10.

The tubulars 104 located within the wellbore 102 may comprise a drill string 120. Tubulars 104 which are connected to the tubulars 104 which are within the wellbore 102, but which are themselves located above the wellbore 102, may also comprise the drill string 120. As new tubulars 104 are attached to the drill string 120 and drilled into the wellbore 102, the new tubulars 104 become part of the drill string 120. A drill string 120 may include any number of tubulars 104.

Upon attachment of the tubular 104 to the stick up, the slip may be loosened from the drill string 120. The weight of the drill string 120 may be supported by the kelly drive 136 or by the top drive 10, which is further supported by the drawwork through the drillline (not shown). The kelly drive 136 and the rotary table 118 or the top drive 10 may rotate the drill string 120 and move the drill string 120 vertically. The drill bit 128 may cut into the ground at the bottom of the wellbore 102, thereby deepening the wellbore 102. During drilling, the Kelly Hose 112 may be used to pump drilling fluid or drilling mud into the drill string 120. The drilling fluid or drilling mud may lubricate the drill bit 128 during the drilling operation.

When a portion of the last tubular 104 added to the drill string 120 is below the rig floor 110, the rotation and vertical movement of the kelly drive 136 or top drive 10 may be stopped. The portion of the last added tubular 104 which is above the rig floor 110 may be referred to as the stick-up 330. The slip 191 may be tightened around the drill string 120.

The process described above may be repeated to add another tubular 104 to the drill string 120 and to further deepen the wellbore 102. This process may be repeated until the wellbore 102 has the desired depth. This process may be repeated any number of times. Following drilling to the desired depth (whether to total depth or for a given stage), the drill string 120 may be tripped out of the hole. If further operation is desired, a casing string (not shown) may optionally be run into the hole and cemented in place.

The drilling rig 100 may include one or more imaging devices 132. The imaging device 132 may be any type of device capable of capturing an image of the drilling rig site. In some embodiments, the imaging device 132 may be a camera, a video camera, an ultrasonic imaging device, an electromagnetic imaging device, a thermal imaging device, a laser range finder, or triangulation device. Other equipment necessary to use a particular type of imaging device may also be included in the drilling rig site. For example, if the imaging device 132 is a thermal imaging device, the drilling rig site may also include equipment capable of injecting heat into the components that are imaged to create a thermal gradient that can be captured by the imaging device 132. The imaging device 132 may capture two-dimensional images or three-dimensional images. In some embodiments, the imaging device 132 may be any type of imaging device known in the art. The drilling rig 100 may include any number of imaging devices 132.

The imaging device(s) 132 may be attached to the drilling rig 100 or may be a stand-alone device present at the rig site. In some embodiments, the imaging device 132 may be fixedly attached to the drilling rig 100. The imaging device 132 may be located such that the imaging device 132 is capable of capturing images which include at least one end of at least one tubular 104. The imaging device 132 may be capable of capturing images of the tubulars including a particular end of a particular tubular 104 at a desired point in the drilling process described above. The imaging device(s) 132 may be capable of capturing images of a tubular, in particular an end of the particular tubular 104 at multiple desired points in the drilling process described above. The imaging device 132 may have a wide field of vision. Multiple imaging devices 132 may be included in the system to capture images of a particular end of a tubular at multiple desired points in the drilling process described above. In some instances, an image captured by the imaging device 132 may also include another desired element, such as an adjacent tubular or other rig components such as a drive device. Multiple imaging devices 132 may be used to simultaneously capture images of the particular end of the particular tubular 104 and the other element.

The images may be transmitted to a processor 134. The processor 134 may be capable of detecting the particular end of the particular tubular 104 in the images. In some embodiments, a marker (not shown) may be attached to or formed in the tubular 104 to facilitate the detection. The processor 134 may also be capable of detecting the other element in the images without attaching any additional marker in the tubular. An existing feature on the tubular, such as a shoulder of the thread, or an edge of the tubular, etc., may be used as a reference marker to detect the desired feature on the tubular. For example, the processor 134 may use edge detection, geometric modeling, machine learning, feature detection, feature description, feature matching, some combination of these processes, or any technique known in the art. The processor 134 may be capable of detecting the desired other element in the images. A marker (not shown) may be attached to or formed in the other element to facilitate the detection. The processor 134 may also be capable of detecting the other element in the images without attaching any additional marker in the tubular. An existing feature on the tubular, such as a shoulder of the thread, or an edge of the tubular, etc, may be used as a reference marker to detect the desired feature on the tubular. In one or more embodiments, the presence of a marker may be used for pattern recognition. For example, once the marker is captured (and subsequently stored), processor 134 may recognize the marker from a subsequent image that is captured. This may apply, for example, to a tool joint when the tubulars and joint are initially run into the well and then subsequently tripped out of the well.

The processor 134 may have access to data about the drilling rig site. In some embodiments, the processor 134 may have access to information about the location of the imaging device 132, the distance between fixed components of the drilling rig site, the size of tools used at the drilling rig, or other spatial or dimensional information.

In some embodiments, the processor 134 may calculate a distance from the end of the tubular 104 to the other element (which may in fact be the other end of the same tubular 104), based on the locations of the end of the tubular 104 and the other element which the processor 134 detects in the images. Images captured by the imaging device 132 may also optionally include a reference element. The dimension(s), e.g. length, of the reference element may be known. The distance between the reference element and the image capturing device may also be known. The reference element may be an element included in the drilling rig site specifically for this purpose, or it may be a functional element of the drilling rig site having a known length, such as a portion of the derrick. The processor 134 may determine the length of the reference element in the image in pixels. Based on the dimension of the reference element, the size of the pixels and the distance between the reference element and the image capturing device, the processor 134 may determine a conversion between pixels and physical length and the distance between the object and the image capturing device. The processor 134 may determine, from the image, the length between the end of the tubular 104 and the other element in pixels. The processor 134 may use the conversion to determine the physical distance between the end of the tubular 104 and the other element. The distance from the imaging device 132 to a reference object, the focal length of a lens of the imaging device 132, and/or the size of the entire image in pixels may be known by the processor 134. This information may be used to determine a conversion between pixels and physical length and thereby determine the distance between the end of the tubular 104 and the other element. A distance of a reference object from the imaging device 132 may be known by a measurement made during set-up of the system, or through acoustic range finding or some other method. If the system includes more than one imaging device 132, or includes an imaging device 132 which can take multiple positions, a parallax method may be used. The processor 134 may also determine the relative movement (such as a lateral displacement) of the same tubular from a number of images taken at different time. In some embodiments, the processor 134 may determine the velocity of the tubular 104. The frame rate of the imaging device 132 may be known to the processor 134. The frame rate of the imaging device 132 may be determined based on a known shutter speed and freezing motion. A length of the tubular 104 may be determined by passing the end of the tubular 104 and the other element, which may be the other end of the tubular 104 across a marker. The processor 134 may use the following equation to analyze the images collected during that process and determine the length of the tubular 104.

$$(V \times Fn)/Fr = L$$

where V=velocity, Fn=number of frames, Fr=Frame rate, and L=length of the tubular.

In some embodiments, the processor 134 may use any method known in the art to calculate the distance between the end of the tubular and the other element based on the image.

The distance between the end of a tubular 104 and another element calculated by the processor 134 may inform the operation of another element of the drilling rig site. In some embodiments, the distance may be displayed to the human operator of the other element of the drilling rig site. The human operator may make decisions about the operation of the drilling rig site element based on the displayed distance. In some embodiments, the processor 134 may directly command the other element of the drilling rig site based on the calculated distance. In some embodiments, the processor 134 may communicate with a processor, programmable logic controller (PLC), or other control system connected directly to the other element of the drilling rig site. The element-specific processor or PLC may command the drilling rig site element based on the calculated distance. In this disclosure, a statement that the processor 134 commands an element of the drilling rig site, may include any of the command procedures above, or any combination thereof. Thus, reference to a processor 134 may encompass significantly more than a single processor.

As shown in FIG. 3, the imaging devices 332 may capture an image of the lower end of a tubular 304 and the upper end of the stick-up 330 (i.e., another tubular sticking above the rig floor). The processor 334 may calculate the distance between end of tubular 304 and stick-up 330. The processor 334 may trigger the command of an iron roughneck (not shown) based on the calculated distance. If the distance is determined to be a desired value, the processor 334 may trigger the command of the iron roughneck to torque the tubular 304 and the stick-up 330 together. Such a procedure may prevent the iron roughneck from being deployed when the tubular 304 and the stick-up 330 are too far apart or too close together.

In some embodiments, the imaging devices 332 may capture an image of the upper end of the stick-up 330 and the rig floor 310. It should be noted the stick-up 330 is composed of a tubular 304. The processor 334 may calculate the distance between the upper end of the stick-up 330 and the rig floor 310. This distance may be referred to as the stick-up height. With reference to FIGS. 1 and 2, this measurement may be made while the drill string 120 is being rotated by the top drive 10 or the rotary table 118 and the kelly drive 136. The processor 334 may command the top drive 10 or the rotary table 118 and the kelly drive 136 based on the calculated distance. If the distance is determined to be a desired value, the processor 334 may trigger the command of the top drive 10 or the rotary table 118 and the kelly drive 136 to stop rotating the drill string 120. This procedure may prevent the drill string 120 from being driven to such a depth that the stick-up height is too great or too small. Further the stickup height may be used as a reference height for the next tubular 304 string to be joined to and torqued together with the stick-up 330, such as by an automated lowering of the next tubular 304 through the drawwork to a height suitable to be joined with the stickup 330, and/or an automated torqueing device (an iron roughneck).

In some embodiments, the imaging device 132 may capture an image of both ends of a tubular 104. The processor 134 may calculate the distance between the two ends of the tubular 104, i.e., the length of the tubular 104. Calculations of the lengths of tubulars 104 which make up the drill string 120 may be used to estimate the length of the drill string 120 and the depth of the wellbore 102. Such a measurement may be used to create an e-tally, which may associate an identification of a tubular 104 to its corresponding length thus determined. The estimated drilled depth of the wellbore 102 may be used when completing the wellbore 102 in a reservoir section. Such a determined depth may enable completion of the wellbore 102 to be more accurate or more efficient. For example, a payzone of a reservoir may be only 50 feet long, whereas the total depth of the well may be significantly larger, such as 10,000 to 20,000 feet. Thus, errors in the total depth drilled could result in missing the payzone. Therefore, by using a drillstring length calculation that sums the length of each of the individual tubulars making up the drill string, the wellbore may be completed in such payzone of the reservoir with a more accurate determination of having reached the payzone. Use of actual tubular lengths that make up the total drilled depth may be more accurate than estimates from other rig components such as the draw works. In one or more embodiments, the total depth drilled may be calculated from the measurement of tubular lengths after the tubulars have stretched under the weight of the total drill string 120 in the well. Thus, it is also understood that such length calculations may also be performed on the bottom hole assembly as well and that such calculations may also be made on a pipe stand as it is being constructed on the catwalk or rig floor such as in a mousehole.

The calculated lengths of the tubulars 104 which make up the drill string 120 may also be used during the removal of the drill string 120 from the wellbore to predict when a joint connecting two tubulars 104 will reach the rig floor 110. Such a prediction may improve the ability of the wellbore equipment lifting the drill string 120 to be stopped when the joint is at a height at which it can be broken so that the uppermost tubular 104 may be removed from the drill string 120 as well as for automating the breaking of the tool joint and hanging the tubular(s) 104 on the pipe rack 124. Additionally, pattern recognition in the tool joint may similarly be used to break down tool joints when tripping out of the well.

In some embodiments, the imaging device 132 may capture an image of the upper end of a tubular 104 and the fingerboard 126 of a pipe rack 124. The processor 134 may calculate distance between the upper end of a tubular 104 and the fingerboard 126 of a pipe rack 124. The measurement may be made while the tubular 104 is being moved to be hung from the fingerboard 126. The processor 134 may command a crane (not shown) or other tool which is used to lift and move the tubular 104 based on the measurement. For example, the crane may be moved more quickly if the upper end of the tubular 104 is relatively far from the fingerboard 126 and slowed down as the end of tubular approaches the fingerboard 126.

In some embodiments, the imaging device 132 may capture an image of the top drive 10 or the kelly drive 136 and/or the rig floor 110, and its connection to any tubular 304. The processor 134 may calculate the distance between the top drive 10 or the kelly drive 136 and the rig floor 110. Thus, while sensors may conventionally be placed on the top drive 10 or the Kelly drive 136 to indicate movement of the drive, the movement alone does not provide an indication of whether the drill string inside the wellbore is being lowered into the wellbore. Based on the images captured, which could provide indication of whether a drill string is connected to the top drive, or the Kelly drive, the movement of block (through the drawworks) can be used in an automated calculation to decide whether a bit depth is changing as a result of changing block position, In some embodiments, the imaging device 132 may capture multiple images over time and the processor 134 may calculate the distance between the end of a tubular 104 and another element in each image. The processor 134 may perform the calculations in real-time. When the distance between the end of the tubular 104 and the other element is determined to be equal to a desired value, or to be greater or less than a threshold value, the processor 134 may command another rig element to perform a particular action. In one or more embodiments, the use of multiple, successive images may allow for the processor to calculate variations between the images.

For example, the imaging device 132 may capture a sequence of images including the lower end of a tubular 104 which is about to be added to the drill string 120 and the upper end of the stick-up 330. The processor 134 may calculate the distance between the lower end of the tubular 104 and the upper end of the stick-up 330 in each image. The calculations may be performed in real-time. When the distance between the lower end of the tubular 104 and the upper end of the stick-up 330 is less than a threshold value, the processor may command an iron roughneck to engage the tubular 104 and the stick-up 330. Similar sequential imaging and calculation procedures may be performed for any of the drilling rig site procedures described above.

The imaging device 132 may capture a series of images of the drill string 120 as the drill string 120 is being drilled into the wellbore 102. The processor 134 may identify and characterize vibrations experienced by a tubular 104 (as part of the drill string 120) based on multiple, successive images of the tubular 104 captured over time. The processor may identify a reference point, such as the end of the tubular 104 or a joint connecting two tubulars 104 in each image. The processor may determine the distance moved by the reference point between images. The processor 134 may use the captured image to determine the severity of the drill string vibration (such as the vibration amplitude). Further, as mentioned above, it is also envisioned that processor 134 may use pattern recognition to identify patterns in a sequence of images captured by the imaging device 132 in order to calculate the rotation speed (RPM) of the drill string The processor 134 may command the top drive 10 or the kelly drive 136 based on the determined vibrations, torque or rotational speed experienced by the drill string 120. A command from the processor 134 may change a torque or rotational speed at which the top drive 10 or the kelly drive 136 rotates. Such a procedure may allow the operation of the top drive 10 or the kelly drive 136 to be adjusted in real time based on conditions in order to mitigate the vibration. In this scenario, the vibration measurement through the captured images could be used as a feedback signal for the top drive rotary control. Thus, for example, such observations at the surface may allow for determination of downhole conditions such as stick and slip, whirling, etc., and which may be countered by varying drilling parameters such as the speed, torque, etc. Thus, in some embodiments, the distance calculated by the processor 134 may be used by the processor 1134 to perform further calculations such as properties of the drill string 120, including but not limited to those described above.

For example, it is also envisioned that the present system may be used to calculate hook load. The imaging device 132 may capture an image of a tubular 104 suspended from the top drive 10 or from the kelly drive 136 and the rotary table 118, or such image may be captured prior to the attachment of the tubular 104 to top drive 10 or kelly drive 136. The lower end of the tubular 104 may not be attached to any other elements. The processor 134 may calculate the distance between the lower end of the tubular 104 and the upper end of the tubular 104, based on the image, as an unstretched length of the tubular 104. The lower end of the tubular 104 may be attached to the drill string 120 using an iron roughneck or other tool. The slip (not shown) may be loosened around the drill string 120 so that the drill string 120 is suspended from the tubular 104. The weight of the drill string 120 may cause the tubular 104 to be stretched. The imaging device 132 may capture a second image of the tubular 104 suspended from the top drive 10 or from the kelly drive 136 and the rotary table 118. The processor 134 may calculate the distance between the lower end of the tubular 104 and the upper end of the tubular 104, based on the second image. The distance may be the stretched length of the tubular 104. The change in the length of the tubular 104 between the first measurement and the second measurement may be used to calculate the hook load of the system. The processor may also have access to other properties of the drilling rig site necessary to calculate the hook load. For example, the processor may have access to material properties of the tubulars 104 and other dimensional properties of the tubulars, such as diameter.

While the above discussion solely uses information obtained by the imaging device 132 to calculate hook load, it is also envisioned, the position of the top drive 10 or the position of the kelly drive 136 may be determined by sensors connected to the top drive 10 or the kelly drive 136. The processor 134 may have access to this position information to calculate hook load. The processor 134 may calculate a stretched or unstretched length of a tubular 104 based on both an image of the lower end of the tubular 104 and the position of the top drive 10 or the kelly drive 136 from the sensor. The processor 134 may use a stretched length and an unstretched length of a tubular calculated in this way to determine the hook load.

In some embodiments, the diameter may also be calculated by the system of the present disclosure. Specifically, the processor may use the images captured of the tubular 104 to calculate a diameter of the tubular 104. The imaging device 132 may capture an image of the tubular 104 from a side view or a top view. The image captured by the imaging device may also include a reference device (not shown). Images captured by the imaging device 132 may also include a reference element. The length of the reference element, and/or its distance relative to the image capturing device may be known. The reference element may be an element included in the drilling rig site specifically for this purpose, or it may be a functional element of the drilling rig site having a known length, such as a portion of the derrick. The processor 134 may determine the length of the reference element in the image in pixels. The processor 134 may determine a diameter of the tubular 104 from a width of the tubular 104 from the side view or by converting an ellipse of an end view of the of the tubular 104 into a circle based on an angle between the imaging device 132 and a plane normal to a longitudinal axis of the tubular 104. The processor 134 may determine a conversion between pixels and physical size based on the length of the image of the reference element. The processor 134 may determine the diameter of the tubular in pixels.

In some embodiments, the processor 134 may determine a property of threads on a tubular 104 based on the calculated diameter. The processor 134 may identify damage to the threads. The processor 134 may inspect male threads based on images captured by the imaging device 132. Multiple images of the threads of the tubular 104 may be used to identify damage. The processor 134 may categorize tubulars 104 as usable or not usable based on the damage identified to their threads. The processor 134 may determine whether or not two tubulars 104 can be joined based on their diameters and their threads. The processor may use pattern recognition to identify damage to threads. If a damaged or mismatch thread is identified, the process may pass the information to an automated control system, such that the automated control system automatically rejects this tubular before it is racked into the pipe rack, or before it is joined into another tubular, or drill string 120.

In some embodiments, identification of damage to threads may be performed before tubulars 104 are placed on the pipe rack 124. Tubulars 104 which are identified as having thread damage that makes the tubulars 104 unusable may not be placed on the pipe rack 124. In some embodiments, identification of damage to threads may be performed after tubulars 104 are removed from the wellbore 102. The tubulars 104 may be cleaned before the imaging device 132 captures images of the tubulars 104. The drilling rig 100 may include a mechanical or hydraulic means of cleaning tubulars 104 and joints connecting tubulars 104 during or after the removal of the tubulars 104 from the wellbore 102.

In some embodiments, the imaging device 132 may capture a series of images containing a marker or known feature of a tubular which may or may not be the end of the tubular 104. The processor 134 may detect a location of the marker or known feature in each of the series of images. The processor 134 may calculate a property of the movement of the tubular 104 based on the series of images. For example, the processor 134 may calculate a rotational speed of the tubular 104 based on the series of images and the times at which the images are captured. The processor 134 may command the top drive 10 or the rotary table 118 and the kelly drive 136 based on the calculated rotational speed.

In some embodiments, based on the detected movement, the processor 134 may calculate a property of a vibration of the drill string 120 based on the series of images. For example, the processor 134 may measure an amplitude or a frequency of the vibration of the drill string 120. The processor 134 may command the top drive 10 or the rotary table 118 and the kelly drive 136 based on the calculation. The commanded operation of the top drive 10 or the rotary table 118 and the kelly drive 136 may minimize the vibration.

In some embodiments, a drilling rig 100 which includes an imaging device 132 and a processor 134 may include one or more sensors (not shown). The sensors may communicate with the processor 134. The data collected by the sensors may be used in conjunction with distances calculated based on images captured by the imaging device 132 to perform further calculations and to command the operation of drilling rig site elements.

Figure 4B:
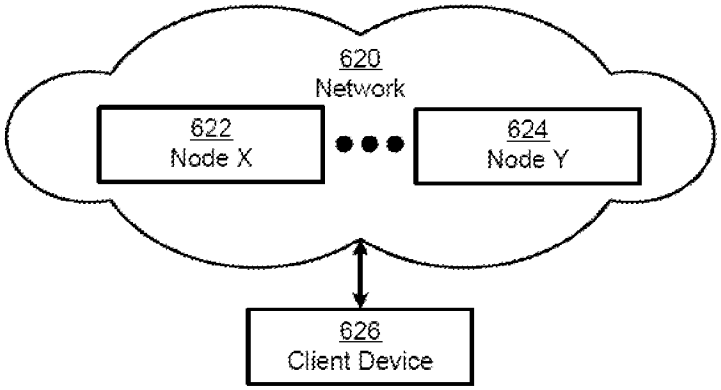
FIG. 4*b* is a schematic of a computing system in accordance with the present disclosure.
Figure 4A:
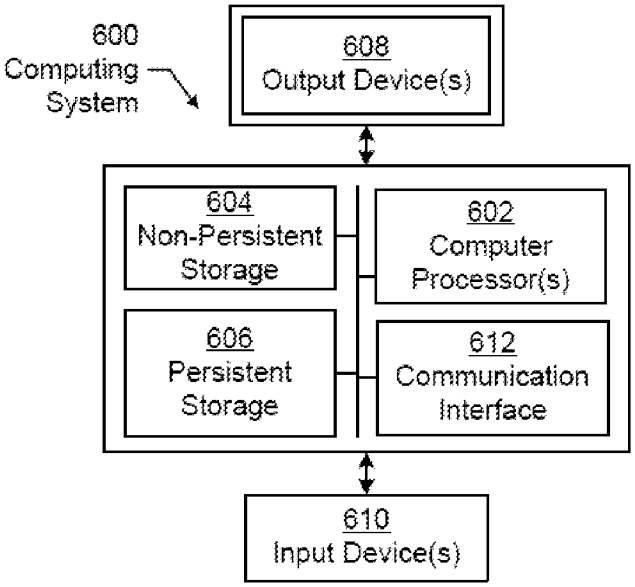
FIG. 4*a* is a schematic of a computing system in accordance with the present disclosure.

Embodiments of the present disclosure may be implemented on a computing system. The computing system may include at least the processor 134 and the imaging device 132. The computing system may include processors or PLCs connected to specific elements of the drilling rig site. Any combination of mobile, desktop, server, router, switch, embedded device, or other types of hardware may be used. For example, as shown in FIG. 4*a*, the computing system 600 may include one or more computer processors 602, non-persistent storage 604 (e.g., volatile memory, such as random access memory (RAM), cache memory), persistent storage 606 (e.g., a hard disk, an optical drive such as a compact disk (CD) drive or digital versatile disk (DVD) drive, a flash memory, etc.), a communication interface 612 (e.g., Bluetooth interface, infrared interface, network interface, optical interface, etc.), and numerous other elements and functionalities.

The computer processor(s) 602 may be an integrated circuit for processing instructions. For example, the computer processor(s) may be one or more cores or micro-cores of a processor. The computing system 600 may also include one or more input devices 610, such as a touchscreen, keyboard, mouse, microphone, touchpad, electronic pen, or any other type of input device.

The communication interface 612 may include an integrated circuit for connecting the computing system 600 to a network (not shown) (e.g., a local area network (LAN), a wide area network (WAN) such as the Internet, mobile network, or any other type of network) and/or to another device, such as another computing device.

Further, the computing system 600 may include one or more output devices 607, such as a screen (e.g., a liquid crystal display (LCD), a plasma display, touchscreen, cathode ray tube (CRT) monitor, projector, or other display device), a printer, external storage, or any other output device. One or more of the output devices may be the same or different from the input device(s). The input and output device(s) may be locally or remotely connected to the computer processor(s) 602, non-persistent storage 604, and persistent storage 606. Many different types of computing systems exist, and the aforementioned input and output device(s) may take other forms.

Software instructions in the form of computer readable program code to perform embodiments of the disclosure may be stored, in whole or in part, temporarily or permanently, on a non-transitory computer readable medium such as a CD, DVD, storage device, a diskette, a tape, flash memory, physical memory, or any other computer readable storage medium. Specifically, the software instructions may correspond to computer readable program code that, when executed by a processor(s), is configured to perform one or more embodiments of the disclosure.

The computing system 600 in FIG. 4*a* may be connected to or be a part of a network. For example, as shown in FIG. 4*b*, the network 620 may include multiple nodes (e.g., node X 622, node Y 624). Each node may correspond to a computing system, such as the computing system shown in FIG. 4*a*, or a group of nodes combined may correspond to the computing system shown in FIG. 4*a*. By way of an example, embodiments of the disclosure may be implemented on a node of a distributed system that is connected to other nodes. By way of another example, embodiments of the disclosure may be implemented on a distributed computing system having multiple nodes, where each portion of the disclosure may be located on a different node within the distributed computing system. Further, one or more elements of the aforementioned computing system 700 may be located at a remote location and connected to the other elements over a network. In one aspect, the present disclosure relates to a method of completing a drilling operation at a rig site. The method may include the step of capturing an image of a tubular at a rig site. The tubular may be configured to be inserted into a wellbore at the rig site. The method may include the step of detecting a location of an end of the tubular from the image. The method may include the step of calculating a diameter of the tubular or calculating a distance between the detected end of the tubular and another element.

A method in accordance with the present disclosure may include capturing an image, calculating a distance based on the image, and using the calculated distance to perform any of the wellbore operations described above. The method may be performed using the system described above or using any system capable of performing the steps of the method.

Methods and systems of the present disclosure may improve the operation of a drilling rig site by allowing the drilling rig site to operate more precisely and efficiently. Drilling rig site equipment, such as an iron roughneck, may be operated when tubulars or other drilling rig site elements are in an optimized position. Methods and systems of the present disclosure may make it possible to determine if the drilling rig site elements are in an optimized position in real-time. Methods and systems of the present disclosure may reduce the time and personnel necessary to make distance measurements between drilling rig site elements. Methods and systems of the present disclosure may allow wellbore parameters such as hook load to be calculated more accurately and allow such calculations to be updated in real-time. Such calculations may improve the performance of other wellbore operations. Such calculations and the resulting command of drilling rig equipment may prevent damage to components of a drilling rig site, such as a drill bit, the drill string, or the top drive.

Methods and systems of the present disclosure may also allow the operation of a drilling rig site to be automated. The imaging device may capture images of drilling rig site elements, the processor may perform calculations based on the images, and the processor may then command drilling rig equipment based on the calculations. This procedure may be carried out iteratively, without input from a human operator, or with less input from a human operator than required by non-automated drilling rig sites. Thereby, automation may the expense of running a drilling rig site, the capacity for human error in a drilling operation, and the number of human operators exposed to potentially dangerous conditions.

While the disclosure includes a limited number of embodiments, those skilled in the art, having benefit of this disclosure, will appreciate that other embodiments may be devised which do not depart from the scope of the present disclosure. Accordingly, the scope should be limited only by the attached claims.

What is claimed is:

1. A drilling rig site comprising:

at least one tubular configured to be inserted into a wellbore at the drilling rig;

at least one imaging device configured to detect a location of an end of the at least one tubular or a feature of the at least one tubular; and a processor receiving an input from the at least one imaging device and configured to calculate a distance between the end of the at least one tubular and a second end of the at least one tubular, wherein the processor is configured to determine a hook load based in part on the calculated distance.

2. The system of claim 1, wherein the imaging device is a camera, a video camera, an ultrasonic imaging device, an electromagnetic imaging device, a thermal imaging device, a laser range finder, or triangulation device.

3. The system of claim 1, wherein the imaging device is configured to capture multiple images over time and wherein the processor is configured to calculate the hook load of the at least one tubular based on each image.

4. The system of claim 1, wherein the processor is connected to one or more control systems configured to control the operation of an iron roughneck, a top drive, drawwork, or rotary table to drive the at least one tubular based on the calculation.

5. A method for completing a drilling operation at a rig site, comprising:

capturing an image of a tubular at a rig site, the tubular configured to be inserted into a wellbore at the rig site;

detecting a location of an end of the tubular or a feature of the tubular from the image;

calculating a distance between the detected end of the tubular and a second end of the tubular;

attaching the tubular to a drive device, wherein the calculated distance comprises a first length of the tubular attached to the drive device;

joining the tubular to a second tubular held in a fixed position in a wellbore by a casing slip;

releasing the second tubular from the casing slip;

re-capturing an image of the tubular attached to the drive device after it is attached to the second tubular and after the second tubular is released;

determining a second length of the tubular from the re-captured image;

determining a change between the first length and the second length of the tubular; and calculating a hook load of the wellbore system based on the change between the first length and the second length of the tubular.

6. The method of claim 5, wherein the drive device comprises a kelly drive or a top drive.

7. The method of claim 5, further comprising:

calculating a total length of a drill string including the first tubular and the second tubular;

determining a drilled depth based on the calculated total length; and completing the wellbore in a reservoir section based on the determined drilled depth.

8. The method of claim 5, further comprising detecting a property of threads of the tubular.

9. The method of claim 5, further comprising capturing successive images of the tubular over time, and detecting changes in the tubular from the successive images.

10. The method of claim 9, further comprising detecting vibrations in the tubular based on the successive images, and adjusting torque and/or rotational speed to the tubular based on the detected vibrations.

11. The method of claim 9, further comprising determining, from the successive images, a rotational speed at which the tubular is moving.

* * * * *